United States Patent [19]

Hausmann

[11] 4,127,954

[45] Dec. 5, 1978

[54] EXTENDED CAPACITY CARTRIDGE MAGAZINE STRUCTURE

[76] Inventor: Erich Hausmann, 1025 S. Westlake, Los Angeles, Calif. 90006

[21] Appl. No.: 785,330

[22] Filed: Apr. 7, 1977

[51] Int. Cl.[2] ..... F41C 25/02

[52] U.S. Cl. ..... 42/50

[58] Field of Search ..... 42/50, 6, 7, 18, 22

[56] References Cited

U.S. PATENT DOCUMENTS

| | | | |
|---|---|---|---|
| 2,311,497 | 2/1943 | Van Horn et al. | 42/50 |
| 2,777,235 | 1/1957 | Hopkins | 42/50 |
| 3,043,198 | 7/1962 | Darsie et al. | 42/50 |
| 3,087,270 | 4/1963 | Stoner | 42/50 |
| 3,345,771 | 10/1967 | Silsby | 42/18 |
| 3,383,790 | 5/1968 | Into | 42/50 |
| 3,453,762 | 7/1969 | Fremont | 42/50 |
| 3,577,860 | 5/1971 | Jestrabek | 42/50 |
| 3,603,020 | 9/1971 | Wiese | 42/50 |
| 3,604,142 | 9/1971 | Silsby | 42/50 |

FOREIGN PATENT DOCUMENTS

| | | | |
|---|---|---|---|
| 90189 | 1/1897 | Fed. Rep. of Germany | 42/18 |

*Primary Examiner*—Charles T. Jordan
*Attorney, Agent, or Firm*—William C. Babcock

[57] ABSTRACT

Two embodiments of a cartridge magazine are disclosed herein; one comprising a universal caliber cartridge housing which may be attached to interchangeable, caliber specific, dispensers adapted for receipt in the magazine opening of a conventional firearm. In a second embodiment, the cartridge housing comprises plural chambers, each provided with its own feed spring, such chambers merging into a single feed channel connected to the dispenser. To assure a coordinated merging of the cartridges within the various channels, the second embodiment includes sequential tripping devices enabling one channel after the completion of dispensing out of the other channel.

8 Claims, 15 Drawing Figures

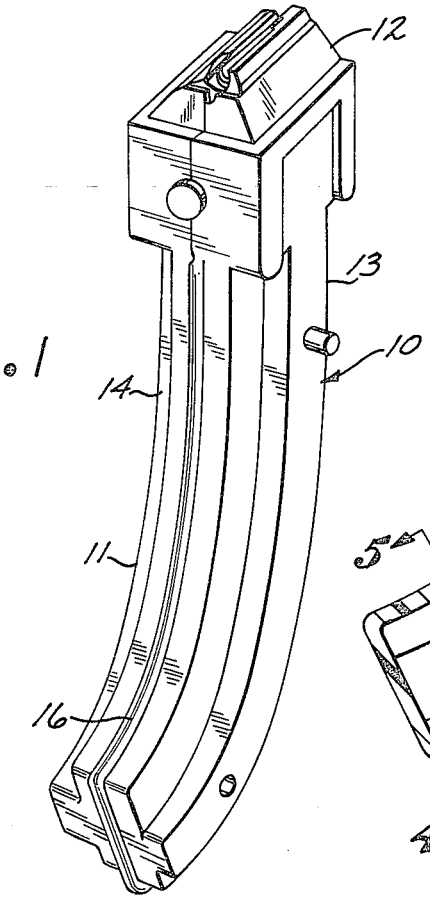
FIG. 1
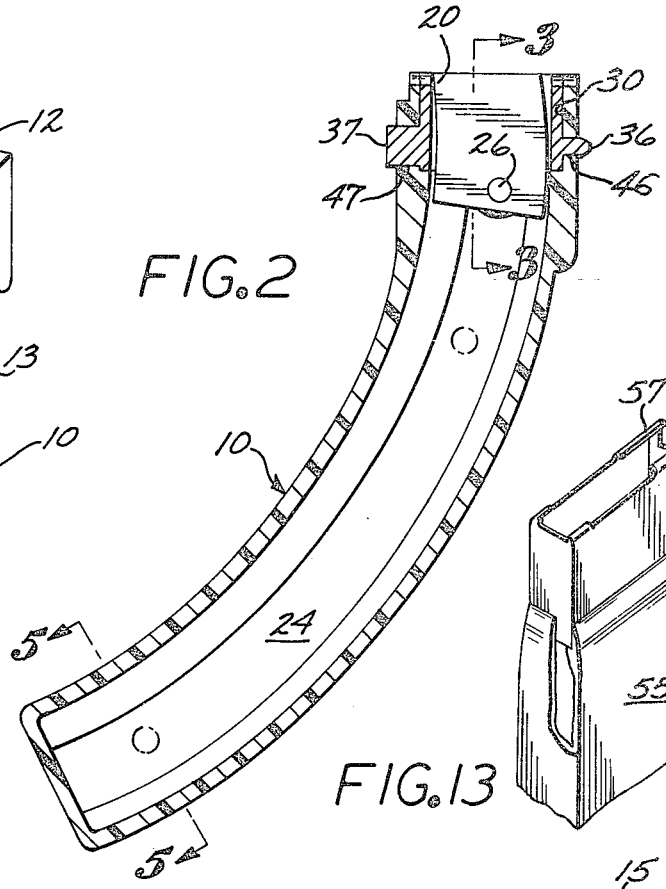
FIG. 2
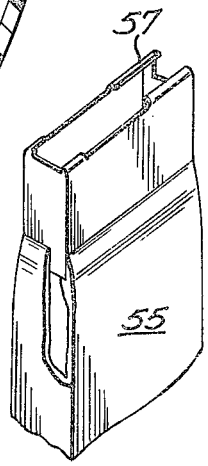
FIG. 13
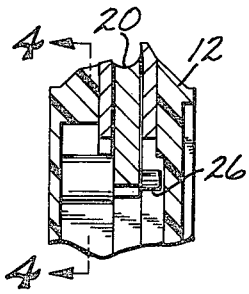
FIG. 3
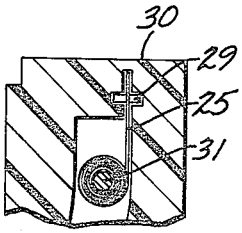
FIG. 4
FIG. 5
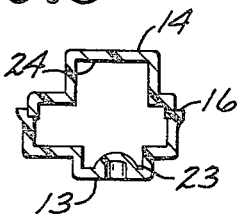
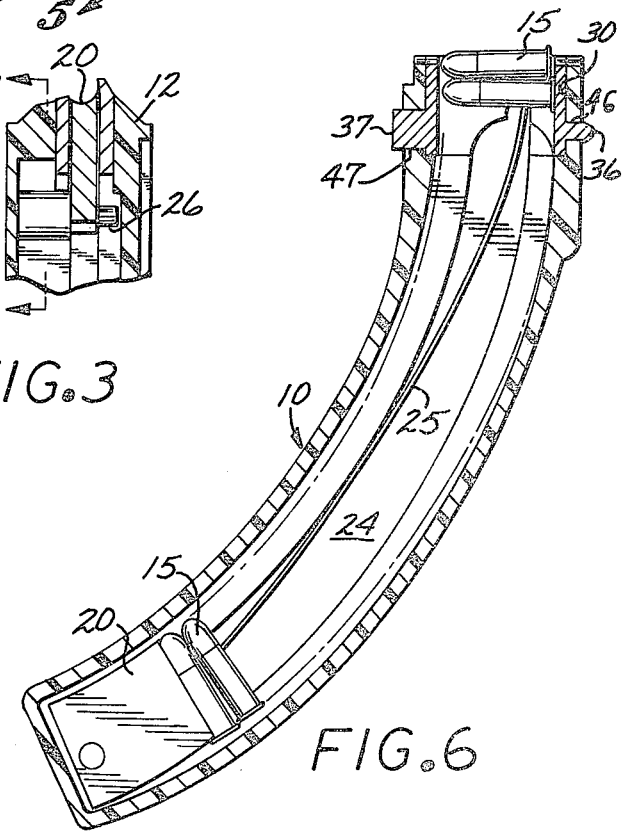
FIG. 6

FIG. 7
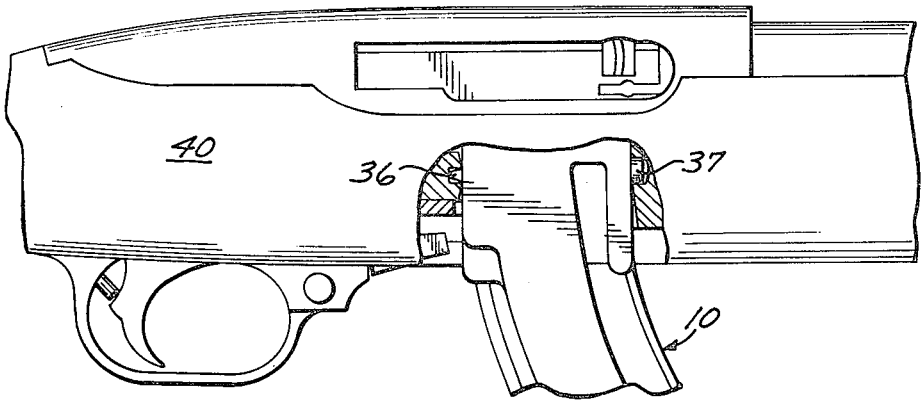
FIG. 8
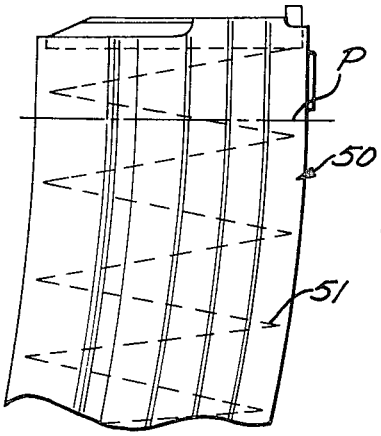
FIG. 9
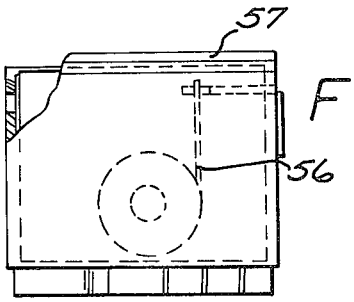
FIG. 10
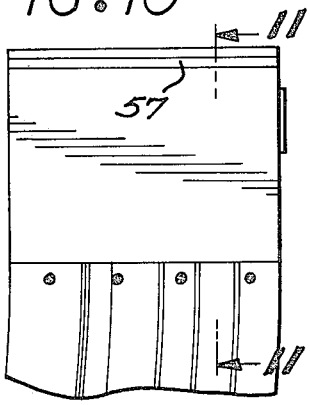
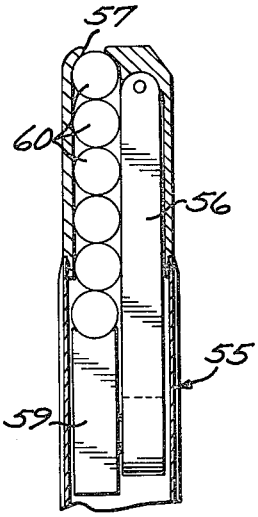
FIG. 11
FIG. 12
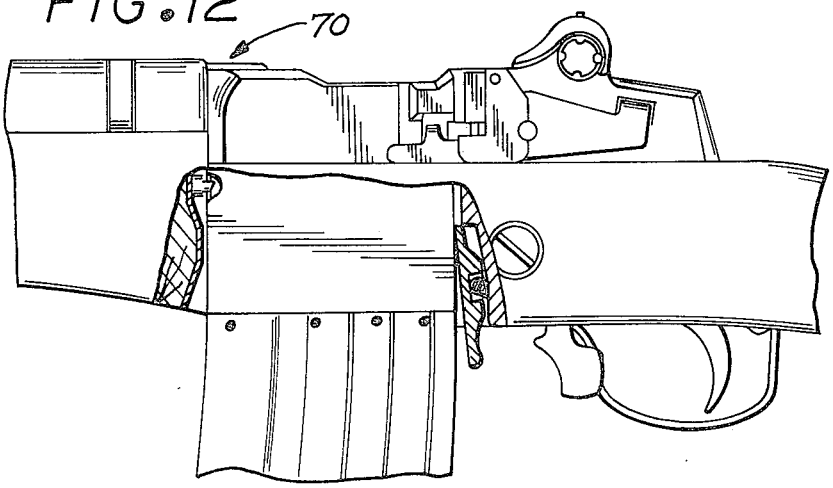

EXTENDED CAPACITY CARTRIDGE MAGAZINE STRUCTURE

BACKGROUND OF THE INVENTION

1. Field of the Invention

The present invention relates to cartridge dispensing magazines, and more particularly to improvements in such magazines for expanding the capacity thereof.

2. Description of the Prior Art

Increasing the capacity of a cartridge dispenser has been subject to many improvements in the past. Heretofor most improvements were either in the configuration of the dispensing spring or similar device or in the receiving structure of the magazine itself. In each instance, however, most prior art improvements were directed at dispensing of cartridges of a particular caliber and the improvements in one were therefore often not adaptable to larger or smaller caliber magazines.

Concurrently, various improvements in the dispensing structure of the magazine itself have occurred with the result that the structure of the dispensing end of the magazine has assumed very specific shapes, each improvement dictating specific modifications to that shape. Accordingly, the practice in the prior art has been such that the whole magazine structure is specifically adapted for use with a particular firearm. As various firearm manufacturers adopt specific breech or chamber configurations added proliferation of magazines having singular use only is bound to occur.

It is to be noted, however, that the only part of a cartridge magazine which is uniquely adapted for a particular firearm is the dispensing part or the part exposing the cartridges for pick up by the bolt. The remainder of the magazine is usually either exposed or is located within confines which are not critical to the operation of the firearm. Accordingly, adaptation of the whole magazine to a singular firearm increases the cost of tooling and more particularly entails the production of many redundant articles which, because of a single feature, cannot be interchanged.

In addition, the use of automated firearms is quickly gaining very wide acceptance both amongst the military and in private use. In each instance a larger consumption of cartridges is entailed and the desired features of increasing magazine capacity and reducing the number of magazines required are regularly sought out. Heretofor the capacity of the magazine has been limited by the stroke of the forcing or advancing device which dispenses the cartridges. Most often this is done by way of a spring which is inherently limited in the dimensions of the stroke, and magazine lengths acceptable by military standards.

SUMMARY OF THE INVENTION

Accordingly, it is the general purpose and object of the present invention to provide a cartridge magazine structure which is conveniently adapted to various breech configurations.

Other objects of the invention are to provide a magazine structure which accummulates the stroke dimensions of a plurality of springs for the purpose of increasing cartridge capacity.

Additional objects of the invention are to provide a magazine structure which is adapted to contain cartridges of varying calibers.

Yet further objects of the invention are to provide a magazine structure wherein progression springs are sequentially actuated.

These and other objects are accomplished within the present invention by combining the dispensing end of a conventional cartridge magazine with a cartridge housing of novel design. More specifically, the cartridge housing is conformed in two mating halves, one half including a channel for containing a spirally wound spring and the other half including a guide for aligning the follower. In this manner, a spirally wound spring is used to advance the cartridges into the dispensing end in substitution for the convoluted springs used in the prior art. To obtain uniformity in the magazine structure, the housing itself is shaped for a particular receiving fit at the upper end thereof only. It is this fit that is matched with the cut-off dispensing end of the prior art magazine. Furthermore, the housing halves themselves are formed out of the plastic structure and upon assembly are thermo or ultrasonically welded together to produce an integral assembly whereby the exposed end of the magazine is thus rendered impervious to dust, moisture, or other debris, and which is structurally stronger then steel.

By way of further improvements, the plastic housing may include a plurality of legs, either circular in plan form or linear, each leg being provided with a spirally wound spring advancing a follower. These legs merge at a point below the dispensing end and for that reason each follower includes an exteriorly directed pin for unlatching the next follower in the adjacent leg. In this manner, each leg is advanced in succession, thus avoiding the uncertainties of cartridge alignment at the merging intersection.

BRIEF DESCRIPTION OF THE DRAWINGS

FIG. 1 is a perspective illustration of a cartridge magazine constructed according to the present invention;

FIG. 2 is a side view in section of a cartridge magazine as shown in FIG. 1;

FIG. 3 is a sectional view taken along line 3—3 of FIG. 2;

FIG. 4 is a sectional detailed view taken along line 4—4 of FIG. 3;

FIG. 5 is a sectional end view taken along line 5—5 of FIG. 2;

FIG. 6 is yet another sectional view of the cartridge magazine shown in FIG. 2, illustrating the disposition of the cartridges therein;

FIG. 7 is a sectional view of a conventional automatic firearm adapted to receive the inventive cartridge magazine disclosed herein;

FIG. 8 is a side view of a prior art magazine illustrating the fractioning thereof for use with the invention herein;

FIG. 9 is a side view, in partial section, of the inventive magazine incorporating the fraction segment of the prior art device shown in FIG. 8;

FIG. 10 is yet another embodiment of a cartridge magazine constructed according to the present invention;

FIG. 11 is a side view in section taken along the line 11—11 of FIG. 10;

FIG. 12 is a detailed sectional view of yet another firearm illustrating the insertion of the magazine shown in FIG. 10;

FIG. 13 is a further embodiment of the joining configuration constructed according to the present invention;

DESCRIPTION OF THE PREFERRED EMBODIMENT

Figure 14:
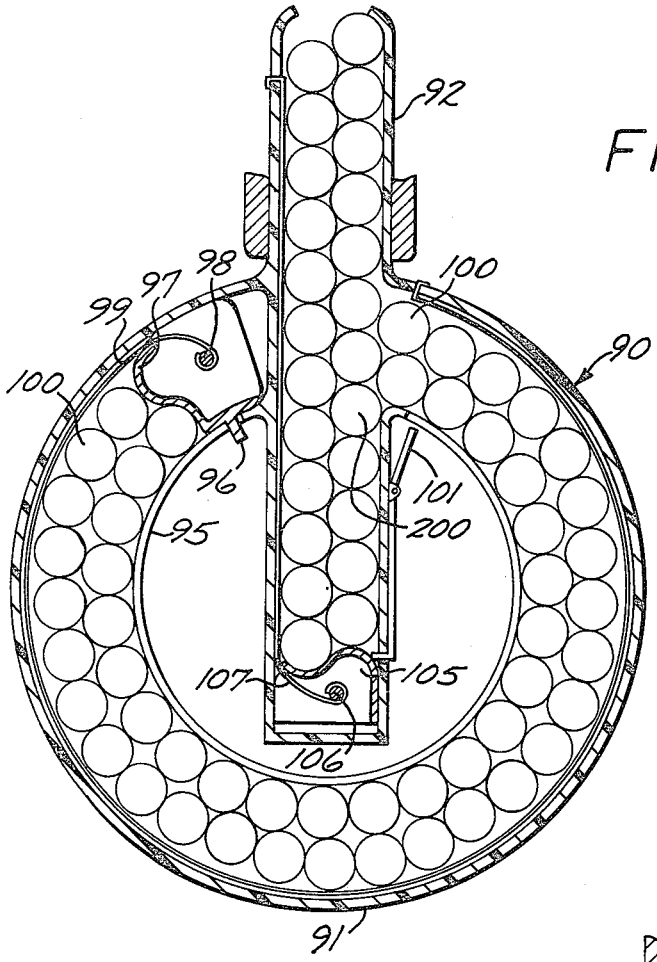
FIG. 14 is a sectional front view of yet another embodiment of a magazine constructed according to the present invention.

By reference to FIGS. 1, 2 and 5, an inventive magazine generally designated by the numeral 10 is shown to comprise a lower housing 11 joined to a dispenser 12 at the upper end thereof. Housing 11 is arcuate in plan form to conform to the stacking arc of a plurality of cartridges 15 on the interior thereof. Housing 11 furthermore, comprises two lateral halves 13 and 14 of a common plan form joined to each other by an overlapping bead 16 extending from the periphery of the housing half 13. To provide for a structure conveniently produced, halves 13 and 14 are made of a relatively rigid plastic such as ABS and are secured to each other by any conventional technique such as thermo-welding, or sonic welding.

As shown in FIGS. 1–6 each housing halves 13 and 14 furthermore include a corresponding interior groove or recess 23 and 24 formed in the opposed surfaces thereof. A follower 20 is slidably received within the interior formed by the two housing halves, extending a spirally wound spring 25 into the interior of groove 24 and a guide pin 26 into the interior of groove 23. The spirally wound spring 25 is secured at the free end thereof to a pin 29 secured proximate the upper end 30 of the housing. The other end of spring 25 is in turn coiled around a post 31 and is secured thereto, post 31 being in turn secured to the follower. In this manner the natural spiral bias of spring 25 will advance the follower 20 towards the position illustrated in FIG. 2. By virtue of this bias, the cartridges 15 shown in FIG. 6 are advanced towards the opening in the dispenser 12 received within the upper end 30. The use of a spirally coiled spring for this purpose provides the necessary substantially constant spring force advancing the cartridges. This spring force in a spirally wound spring can extend over a longer dimension than the normally used convoluted springs in the prior art. Thus, housing 11 may accommodate a larger number of cartridges by this expedience. Furthermore, the use of plastic for the housing structure reduces the internal friction that may occur between the cartridges or the follower and the interior, thus reducing the necessary spring bias levels and therefore reducing the size of the spring.

The use of plastic, however, is not compatible with the high force level and sliding retention occurring at the dispenser end 12. For this reason dispenser 12 comprises a metal structure and may include a section of a prior art magazine embedded within the upper opening 30. To accommodate convenience in assembly, dispenser 12 may furthermore include two longitudinally opposed and exteriorly directed posts 36 and 37 which are received in corresponding semi-circular cut outs 46 and 47 formed in the opposed edges of halves 13 and 14. Thus, during the welding process of bead 16 to the adjacent edge of the half 14, the necessary engagement is made with the dispenser 12. Posts 36 and 37 may furthermore provide the necessary engaging features for use in securing the magazine 10 to a conventional firearm such as the firearm 40 shown in FIG. 7.

A further embodiment of the inventive magazine is shown in FIGS. 8–13. More specifically, FIG. 8 illustrates the general configuration of a prior art magazine designated by the numeral 50 and including the aforementioned convoluted spring 51 on the interior thereof. For the purposes herein the dispensing end of the prior art magazine 50 may be cut off along the plane shown as the plane P to be joined, as shown in FIG. 11 to the upper opening of a plastic housing 55. Similar to the structure disclosed above, a spirally wound spring 56 is deployed between the opening 57 in the dispensing end and a follower 59. It is this follower that advances the stack of cartridges 60 with the spring 56 occupying the space previously provided for the spring 51. In this manner the engaging features of the prior art magazine relative the firearm 70 shown in FIG. 12 are maintained while the capacity of that magazine is concurrently expanded. As shown in FIGS. 10 and 11 the attachment of housing 55 may be made by a plurality of rivets, or in the alternative as shown in FIG. 13 a snap-on configuration can be provided whereby housing 55 is snaped around the lower edge of the dispensing end of magazine 50. In either instance the exterior shape of housing 55 proximate its upper opening is tapered both to accommodate the necessary clearances within the firearm 70 shown in FIG. 12 and to allow for a thinned section useful in the process of engagement.

Figure 15:
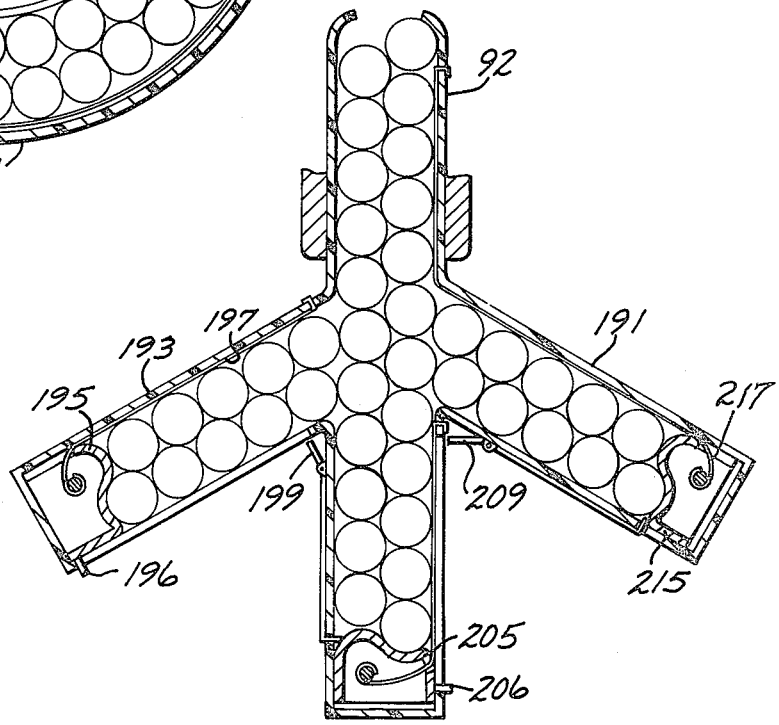
FIG. 15 illustrates a further embodiment of a magazine disclosed herein.

While the foregoing discourse has been primarily directed at the attachment interface of a cartridge housing with a prior art dispensing fixture, it is to be noted that various other configurations expanding the capacity can be achieved. More specifically, as shown in FIGS. 14 and 15, two alternative embodiments expanding the cartridge capacity are shown. FIG. 14 illustrates a configuration wherein the magazine is conformed in the manner of a drum generally designated by the numeral 90 comprising a circular housing segment 91 merging with a linear housing segment 92. Housing segment 91 includes on the interior periphery thereof a surface groove 95 through which a pin 96 attached to a follower 97 extends. Once more, follower 97 includes a post 98 to which a spirally wound spring 99 is attached. The disposition of spring 99 within the interior of housing segment 91 is along a surface opposite to the surface containing the groove 95. Thus, the cartridges shown herein as cartridges 100 are contained within the housing 91, occupying the space between spring 99 and the groove 95. As the cartridges are dispensed into the firearm at the upper end of housing section 92, follower 97 is permitted to advance until the full circumferential advancement is achieved, i.e. until all the cartridges within housing segment 91 are dispensed. At this point in advancement, pin 96 engages a lever 101 which is positioned to secure yet another follower 105 deployed in its lowermost position in the housing 92. Once more, follower 105 is provided with a post 106 around which a spirally-wound spring 107 is secured, spring 107 being once more deployed within the interior of the housing to advance the cartridges therein once the lever 101 is shifted. In order to distinguish between the two merging halves, the cartridges above follower 105 are labeled as cartridges 200 while the cartridges 100 illustrate the path of propagation or advancement through the circular housing 91 and into the upper end of housing 92. Thus, a coordinated sequence of cartridge advance is achieved which avoids the possibility of jam-ups at the point of merger between the two housings.

It is to be understood that cartridges 100 will advance while cartridges 200 will maintain a stationary position until follower 97 completes the travel through the housing 92. It is only then that the follower 105 will be released, allowing the advancement of cartridges 200 into the firearm.

By way of a similar arrangement of parts, various other merging conditions can be achieved. More specifically, as shown in FIG. 15 the vertical housing segment 92 is shown to merge with two lateral housing segments 191 and 193. Housing 193 includes, once more, a spirally wound spring 197 extending between the point of intersection thereof with housing 92 and a corresponding follower 195. Follower 195 is similarly provided with a pin 196 which, at the completion of its travel again engages a lever 199 releasing a follower 205 latched at the bottom of the vertical housing 92. Again, follower 205 is provided with a pin 206 which extends to the exterior of the housing to engage, once more, a lever 209 securing yet another follower 215 at the bottom end of housing 191. It is to be noted that by virtue of this engagement the order of progression of cartridges comprises the following sequence:

A. Housing 193 is first emptied by the advancement of follower 195 until engagement is made with the lever 199. This engagement and the securing location of the free end of spring 197 limits any further translation of this follower.

B. Follower 205 is then released and advances until pin 206 extending therefrom engages lever 209. Again, this limits the advancement of follower 205.

C. On relief of lever 209 follower 215 is allowed to advance and will advance through housing 191 and into the upper end of housing 92 by virtue of the deployment of the spiral spring 217 extending between this follower and the upper end of housing 92.

In this manner various merging arrangements can be accommodated by a controlled sequence of progression, it being understood that additional extensions to the number of paths set out be fully achieved by the simple extension of the techniques disclosed herein.

Obviously many modifications may be made to the invention without departing from the spirit thereof. It is therefore intended that the scope of the invention be determined solely dependent on the claims hereto.

I claim:

1. In a cartridge magazine adapted for use with a firearm having a bolt mechanism, said cartridge magazine including a dispensing opening conformed to cooperate with said bolt mechanism, the improvement comprising:

a housing including a first and second opposingly mating structures secured to surround said dispensing opening at one end thereof;

a follower disposed between said first and second mating structures for sliding articulation therebetween;

a spirally wound spring attached to a first lateral side of said follower at one end thereof and to said first mating structure proximate said dispensing opening at the other end thereof;

a first longitudinal recess formed within said first mating structure for receiving said spring therein in coiling translation within said housing;

a second longitudinal recess formed in said second mating structure in substantially opposing relationship with said first longitudinal recess; and a guide projection extending from the other lateral surface of said follower for sliding translation within said second longitudinal recess.

2. Apparatus according to claim 1 wherein:

said housing comprises a plastic material structure.

3. Apparatus according to claim 2 wherein:

said first and second mating structures are joined by a peripheral bead formed on one end thereof extending to surround the corresponding edge of the other one thereof.

4. Apparatus according to claim 2 wherein:

said housing is secured to said dispensing opening by way of rivet attachment.

5. Apparatus according to claim 2 wherein:

said housing includes a reduced thickness cavity proximate said one end thereof having a peripheral dimension just smaller than the periphery of said dispensing opening.

6. A cartridge magazine adapted for use with a firearm, comprising:

an elongated first cartridge receiving housing terminating in a cartridge dispensing opening at one end thereof and an oppositely disposed end portion thereof;

a second cartridge receiving housing communicating with said first housing said second housing being in the form of a torus around said end portion of said first housing;

a first and second follower respectively received for sliding translation within said first and second housing;

a first and second spring disposed within said first and second housing for advancing respectively said first and second followers towards said dispensing opening;

engaging means disposed in said first housing for retaining said first follower at a distal relationship from said dispensing opening; and releasing means formed on said second follower and adapted to engage said engaging means for articulating said releasing means and thus releasing said first follower when said second follower approaches said first housing.

7. Apparatus according to claim 6 wherein:

said first and second springs comprise spirally wound springs deployable within the interiors of said first and second housings.

8. Apparatus according to claim 7 wherein:

said second spring is attached to said torus shaped housing; and said second follower is disposed in said second housing.

* * * * *